US006698803B2

(12) United States Patent
Furlong

(10) Patent No.: US 6,698,803 B2
(45) Date of Patent: Mar. 2, 2004

(54) DOOR LATCHING MECHANISM

(75) Inventor: Jonathan W. Furlong, Colorado Springs, CO (US)

(73) Assignee: Schlage Lock Company, Colorado Springs, CO (US)

( * ) Notice: Subject to any disclaimer, the term of this patent is extended or adjusted under 35 U.S.C. 154(b) by 0 days.

(21) Appl. No.: 09/760,410

(22) Filed: Jan. 12, 2001

(65) Prior Publication Data

US 2002/0093206 A1 Jul. 18, 2002

(51) Int. Cl.[7] ..... E05C 1/12

(52) U.S. Cl. ..... 292/165; 292/167; 292/169.15; 292/169.17; 292/169

(58) Field of Search ..... 292/165, 169, 292/169.17, 169.15, 167, 336.5

(56) References Cited

U.S. PATENT DOCUMENTS

| | | | |
|---|---|---|---|
| 2,538,688 | A | 1/1951 | Heyer |
| 2,733,088 | A | 1/1956 | Fisler et al. |
| 2,800,351 | A | 7/1957 | Schmid |
| 3,655,230 | A | 4/1972 | Armstrong |
| 4,169,618 | A | 10/1979 | Potter et al. |
| 4,424,691 | A | 1/1984 | Foshee |
| 4,428,212 | A | 1/1984 | Best et al. |
| 4,594,864 | A | 6/1986 | Hart |
| 4,662,198 | A | 5/1987 | Scherbing |
| 4,838,053 | A | 6/1989 | Shen |
| 4,869,083 | A | 9/1989 | DeMarseilles et al. |
| 4,930,822 | A | 6/1990 | Shen |
| 4,995,249 | A | 2/1991 | Preissler et al. |
| 5,020,343 | A | 6/1991 | Hart et al. |
| 5,123,682 | A | 6/1992 | Robida et al. |
| 5,141,269 | A | 8/1992 | Haq et al. |
| 5,177,987 | A | 1/1993 | Shen |
| 5,269,162 | A | 12/1993 | Robida et al. |
| 5,335,948 | A | 8/1994 | Norton, II et al. |
| 5,364,139 | A | 11/1994 | Bergen et al. |
| 5,385,374 | A | 1/1995 | Fann et al. |
| 5,564,296 | A | 10/1996 | Theriault et al. |
| 5,590,555 | A | 1/1997 | Kester et al. |
| 5,593,193 | A | 1/1997 | Heim |
| 5,605,064 | A | 2/1997 | Katayama et al. |
| 5,636,882 | A | 6/1997 | Hook |
| 5,727,406 | A | 3/1998 | Banducci |
| 5,732,578 | A | 3/1998 | Kang |
| 5,735,556 | A | 4/1998 | Chan |
| 5,761,936 | A | 6/1998 | Katayama |
| 5,768,926 | A | 6/1998 | Shen |
| 5,769,472 | A | 6/1998 | Small |
| 5,909,919 | A | 6/1999 | Wang |
| 5,983,687 | A | 11/1999 | Shen |
| 6,038,894 | A | 3/2000 | Hu |

*Primary Examiner*—Robert J. Sandy
*Assistant Examiner*—Matthew E. Rodgers
(74) *Attorney, Agent, or Firm*—Michael Best & Friedrich LLP

(57) ABSTRACT

A door latching mechanism includes a slide housed within a frame adapted for sliding motion of the slide within the frame and a spindle rotatably mounted to the frame and adapted to move the slide between a retracted and an extended position. A void is defined between an exterior surface of the frame and an interior surface of a cover housing the frame and the slide. An insert includes wings, which extend into the void and are positioned on opposite sides of the slide from each other.

20 Claims, 3 Drawing Sheets

DOOR LATCHING MECHANISM

BACKGROUND AND SUMMARY OF THE INVENTION

The present invention relates to a latching mechanism for securing a door and particularly to a door latching mechanism which includes a lock chassis designed to move a latchbolt between an extended and a retracted position.

Conventional door latching mechanisms include a lock chassis which moves a latchbolt between an extended position and a retracted position. In the extended position, the latchbolt engages a hole in the door frame and the door cannot freely open. With the latchbolt retracted, the door can be freely opened.

A typical lock chassis includes a spindle that interacts with a slide. The slide is typically slidably positioned between a chassis frame and a chassis flange coupled to the chassis frame. Rotation of the spindle translates into linear motion of the slide through a camming action. The slide engages the latchbolt and "pulls" the latchbolt out of its extended position and into its retracted position. The spindle of a typical lock chassis is coupled to a door handle or lever and is rotated when a user turns the door handle. Thus, turning the door handle draws the latchbolt out of its extended position and into its retracted position, allowing the door to be opened. Further, a typical lock chassis includes a cover, which surrounds and contains the chassis frame, the slide, and the flange.

Given the structure described above, a lateral blow to the door handle is translated through the lock chassis via the spindle. Because of this, such a blow to the door handle can cause the chassis frame to separate from both the chassis flange and the cover inside the door. In this way, access to the lock chassis can be gained from the outside of the door and the latchbolt can be retracted, thus allowing the door to be opened by an unauthorized user.

For a door latching mechanism to achieve a particular rating, industry regulations dictate that the lock chassis withstand certain lateral forces applied to the door handle. Therefore, a device that is readily installable on a lock chassis and which enables a lock chassis to withstand certain lateral forces would be welcomed by users of such a lock chassis.

According to the present invention, a lock chassis includes an insert having two wings positioned on opposite sides of a slide of the lock chassis from each other and at least a portion of each wing is positioned to lie between the slide and an interior surface of a cover, which houses the slide.

In preferred embodiments, the insert is positioned around a spindle and a hub of the lock chassis and the two wings flank a chassis frame housed within the cover. The frame is coupled to a flange and houses the slide, which is adapted to move linearly with respect to the frame. In preferred embodiments, the insert is made of zinc and its wings consume a substantial portion of a void which exists between an exterior surface of the frame and the interior surface of the cover.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly prefers to the accompanying figures in which.

DETAILED DESCRIPTION OF THE DRAWINGS

Figure 1:
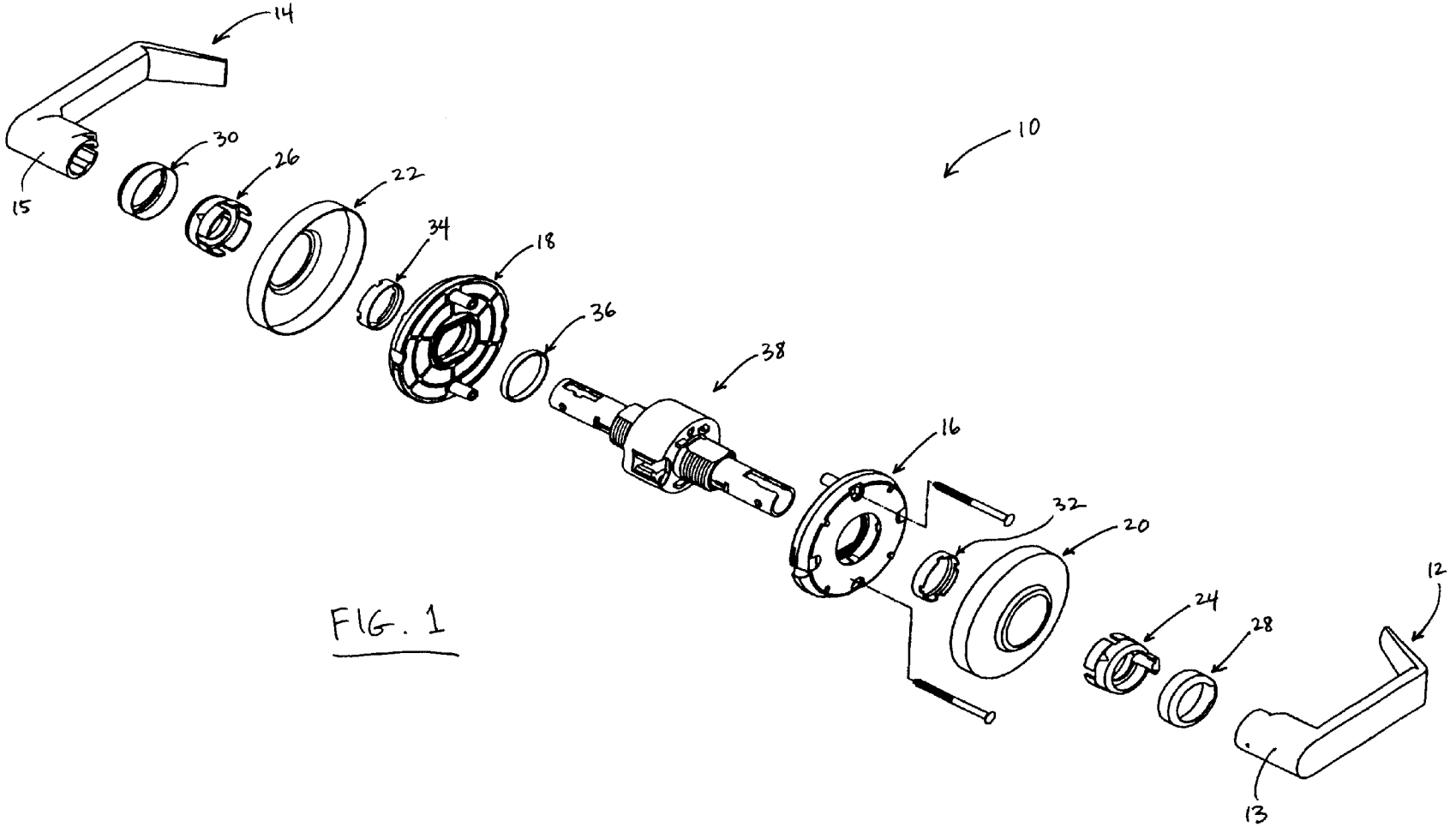
FIG. 1 is an exploded view of a door latching mechanism in accordance with the present invention, including a lock chassis, two door handles, and various other components of the latching mechanism.

Referring to FIG. 1, a door latching mechanism 10, according to the present invention, includes inside and outside levers 12, 14, spring cages 16, 18, roses 20, 22, drivers 24, 26, caps 28, 30, bushings 32, 34, and a spacer 36, as is typical in conventional door latching mechanisms. According to the present invention, door latching mechanism 10 further includes a lock chassis 38, which includes an insert 80 (not visible in FIG. 1), the structure and position of which will become apparent below with reference to FIGS. 2, 3, and 4. Additionally, the door latching mechanism 10 includes a draw bar and latch bolt (both not shown), which will be readily apparent to one of ordinary skill in the art viewing FIG. 1.

Figure 2:
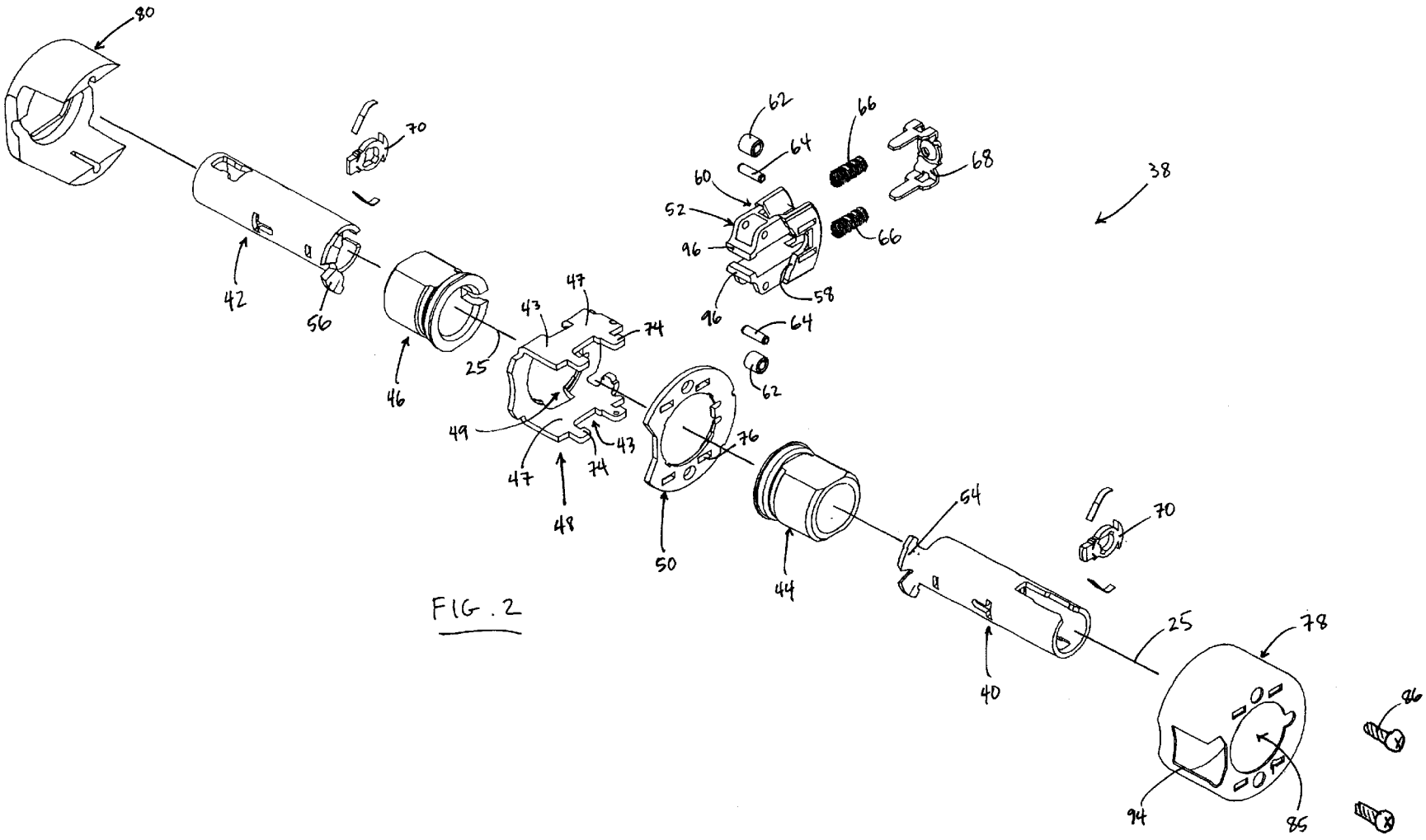
FIG. 2 is an exploded view of the lock chassis of FIG. 1, including an insert, a cover, spindles, hubs, a frame, a flange, and a slide.

FIG. 2 illustrates an exploded view of the lock chassis 38 of the door latching mechanism 10. The lock chassis 38 includes inside and outside spindles 40, 42 and hubs 44, 46 aligned along a chassis axis 25, and a frame 48 and a flange 50, which house slide 52. Referring to FIGS. 1 and 2, as will be readily apparent to one of ordinary skill in the art, rotation of levers 12, 14 rotates spindles 40, 42, respectively, thereby causing the slide 52 to slide within a chamber 49 defined between sidewalls 47 of the frame 48. As will also be readily understood by one of ordinary skill in the art, sliding motion of the slide 52 within the chamber 49 is accomplished by inside and outside cams 54, 56, formed as part of inside and outside spindles 40, 42. Inside and outside cams 54, 56 engage inside and outside cam surfaces 58, 60 of the slide 52 when spindles 40, 42 are rotated. Rotation of spindles 40, 42 thus causes the slide 52 to linearly translate within the frame 48. Linear translation of the slide 52 causes the draw bar and corresponding latchbolt (both not shown) to move between an extended and retracted position. It will also be readily apparent to one of ordinary skill in the art that cams 54, 56 may be formed as separate structures instead of being formed as part of inside and outside spindles 40, 42 as they are shown in FIG. 2.

Inside and outside hubs 44, 46 provide bearing surfaces for spindles 40 and 42, respectively. Sliding movement of the slide 52 within the chamber 49 of the frame 48 is facilitated by rollers 62 mounted on axles 64 and springs 66 positioned between a seat 68 and the slide 52. A user rotates either lever 12 or 14 to rotate spindle 40 or 42 to retract the slide 52 and thereby retract the latchbolt. The slide 52, and thus the latchbolt, are returned to an extended position by the springs 66. Spring-loaded knob catches 70 are placed within inside and outside spindles 40 and 42 and engage levers 12, 14 to secure levers 12, 14 to spindles 40 and 42, respectively.

Figure 3:
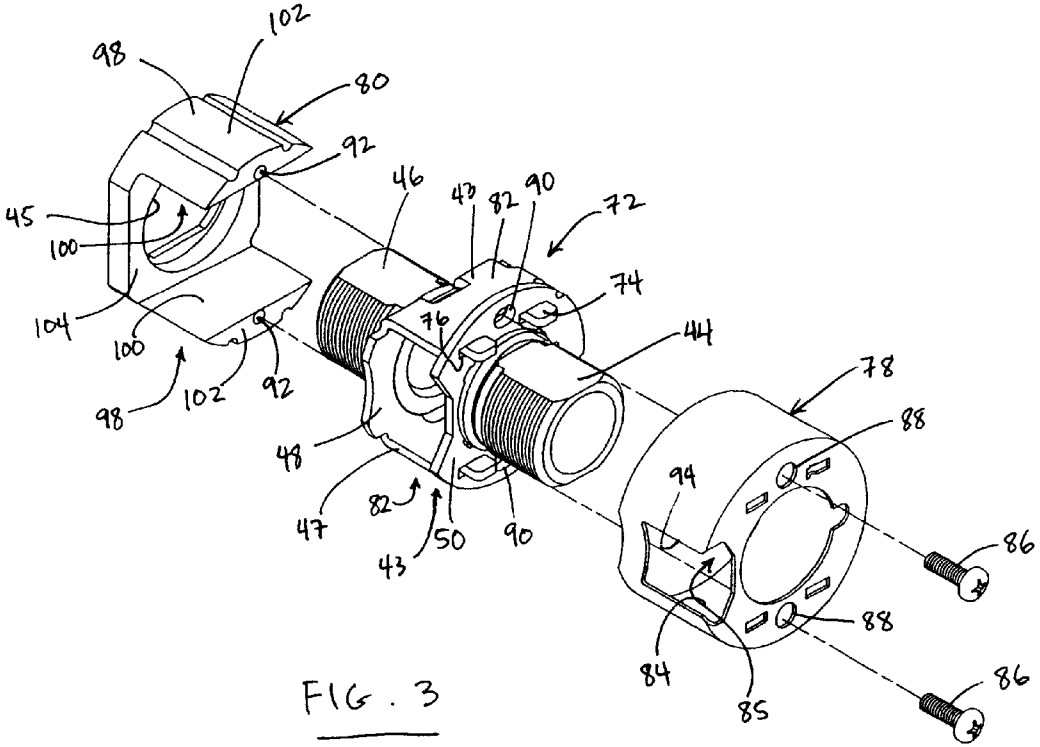
FIG. 3 illustrates a core of the lock chassis assembled, including the hubs, frame and flange, and the insert and cover being secured around the assembled chassis core.
Figure 1:
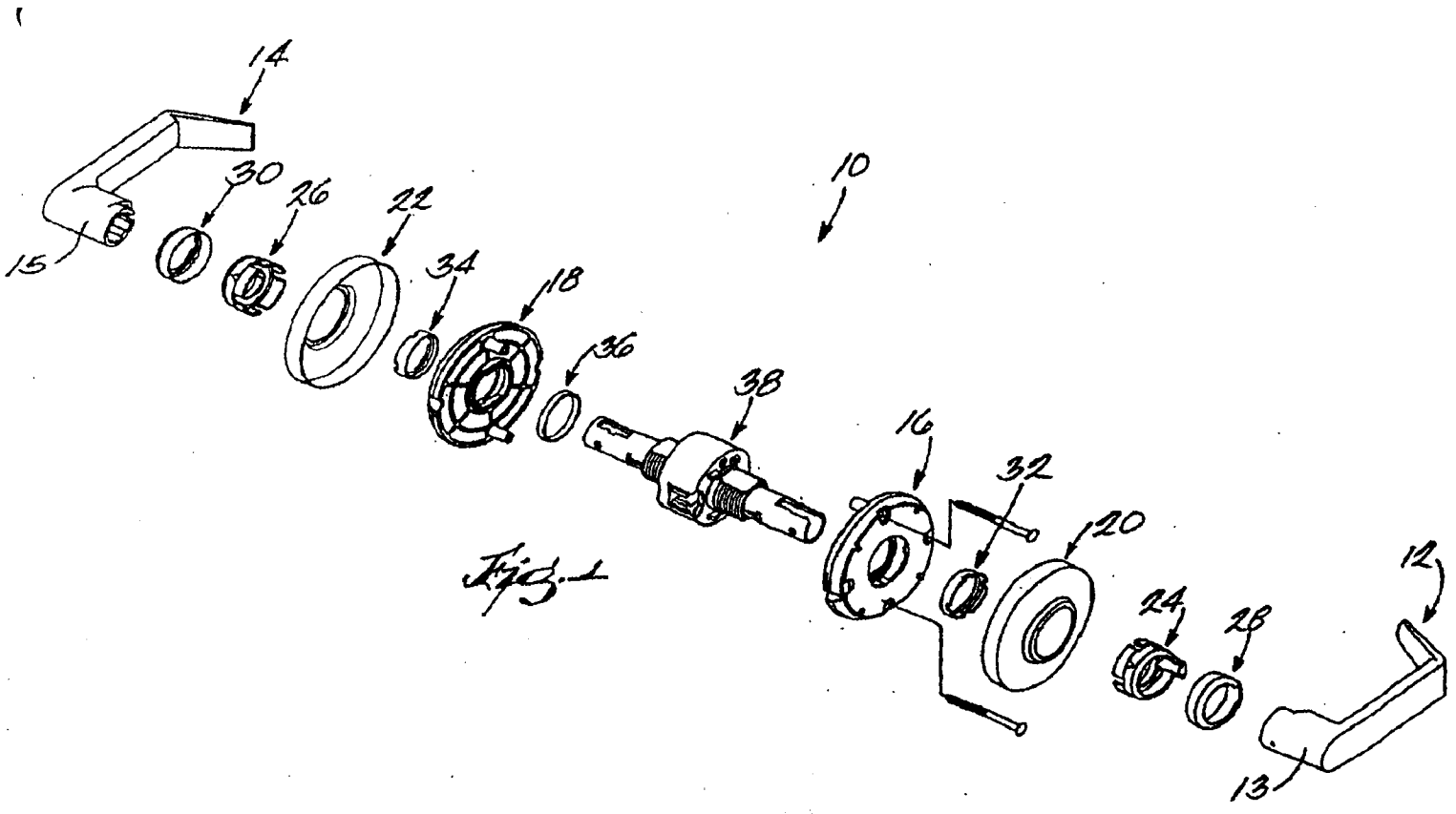
Figure 2:
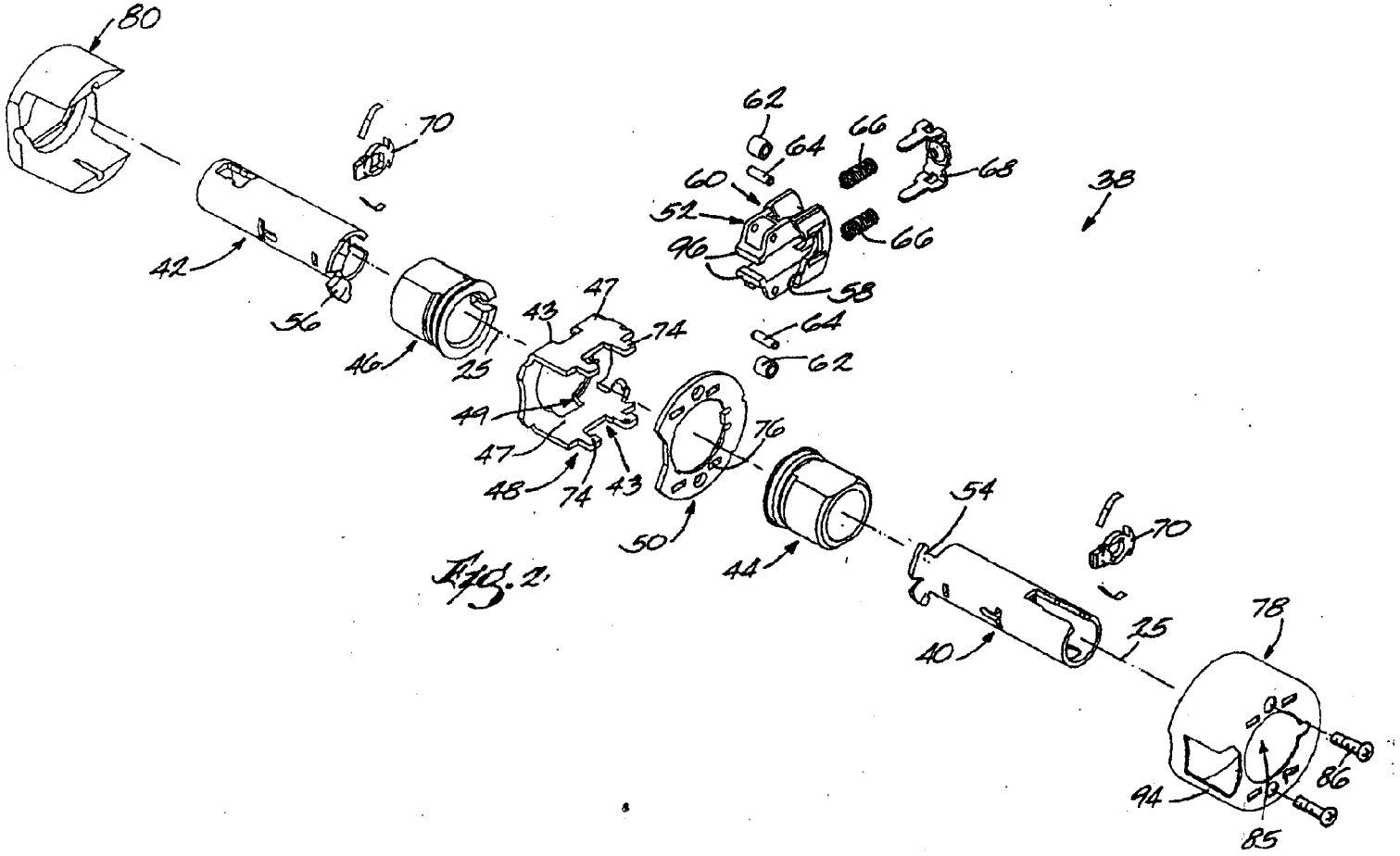
Figure 4:
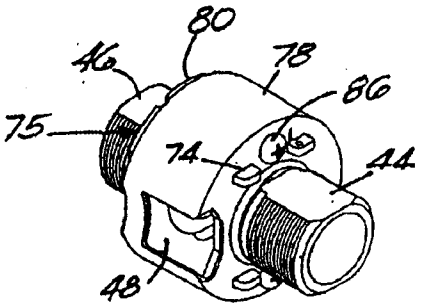
Figure 3:
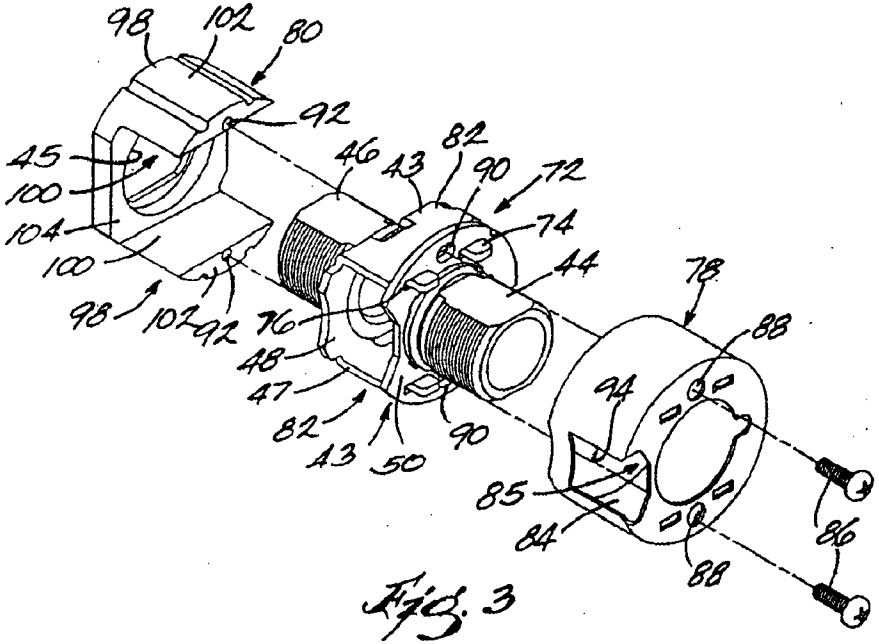

Referring to FIG. 3, a chassis core 72, which comprises the frame 48, flange 50 and hubs 44, 46, is held together by four hook-shaped legs 74 formed as part of the frame 48 and extending from sidewalls 47. The legs 74 extend through and engage slots 76 in the flange 50. Additionally, the chassis core 72 is secured by a cover 78 which houses the frame 48 and the flange 50, and the insert 80, which is positioned to lie around the outside hub 46 and includes two wings 102 positioned between outward faces 43 of sidewalls 47 and an interior surface 84 of the cover 78. The interior surface 84 of the cover 78 defines an interior space 85 which houses the frame 48, the flange 50, and the slide 52. And, the outside spindle 42, along with the outside hub 46, extends through an aperture 45 formed in the insert 80. Two screws 86 fit through openings 88 in the cover 78 and openings 90 in the flange 50 and into threaded holes 92 in the wings 102 of the insert 80 to further secure the chassis core 72. However, it will be understood by one of ordinary skill in the art that other methods (e.g., self-tapping screws, bolts and nuts, rivets, pins, stakes, etc.) may be used to secure the cover 78 to the insert 80.

Referring again to FIGS. 1 and 2, the door latch and draw bar, mentioned above, fit through window 94 in the cover 78. The draw bar engages jaws 96 of slide 52, thereby moving between an extended and retracted position as lever 12 or 14 is rotated.

Figure 4:
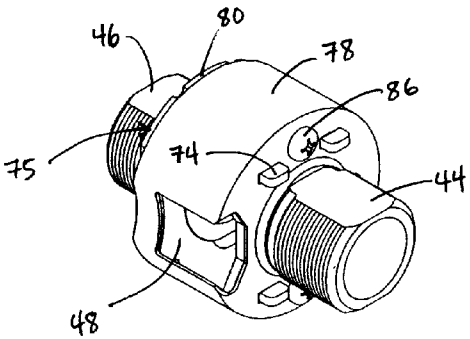
FIG. 4 illustrates the chassis core of FIG. 3 with the insert and cover coupled to the chassis core.

According to a presently preferred embodiment of the present invention, as shown in FIGS. 3 and 4, the insert 80 comprises zinc and includes two wings 102, which fit snuggly in a void 75 between an exterior surface 82 of the frame 48 and portions of the interior surface 84 of the cover 78. In this way, exterior surfaces 98 of wings 102 lie in close proximity to portions of the interior surface 84 of cover 78, and interior surfaces 100 of wings 102 lie in close proximity to the exterior surface 82 of the frame 48. In the event a lateral force is applied to either lever body 13 or 15 of lever 12 or 14 (see FIG. 1), the force will be translated to the chassis core 72 via spindles 40, 42. The force will be dissipated by the insert 80 which distributes the force over a portion of the surface area of the interior surface 84 of the cover 78. The cover 78 in turn distributes the force over an interior surface of a bore (not shown), which is cut into the door to house the latching mechanism 10. The force is then further dissipated through the door itself (also not shown).

Moreover, the screws 86 tighten the cover 78 and the insert 80 around the flange 50, with a back wall 104 of the insert 80 firmly holding the frame 48 to the flange 50 when assembled, as illustrated in FIGS. 3 and 4. In this way, the chassis core 72 is held rigid and can withstand both lateral forces applied to the lock chassis 38 perpendicular to the chassis axis 25 and axial forces applied to the lock chassis 38 parallel to the chassis axis 25. It will be readily understood by one of ordinary skill in the art that the insert 80 may be constructed of materials other than zinc (e.g., other metals, such as aluminum, steel, etc. and plastics, etc.).

Although the invention has been described in detail with reference to certain preferred embodiments, variations and modifications exist within the scope and spirit of the invention as described and defined in the following claims.

What is claimed is:

1. A door latching mechanism, comprising:

a slide;

a spindle defining a chassis axis and being adapted to engage the slide and translate rotational motion of the spindle around the chassis axis into linear motion of the slide perpendicular to the chassis axis;

a frame having an exterior surface, the frame being formed to define a chamber adapted to facilitate sliding motion of the slide within the chamber and relative to the frame;

a cover having an open end, a substantially closed end axially spaced from the open end, and an interior surface extending between the open end and the substantially closed end, the open end, the closed end, the interior surface of the cover, and the exterior surface of the frame defining a void; and an insert having two wings extending into the void, the two wings being positioned on opposite sides of the slide from each other, the insert having an outer surface defining an insert volume, the insert volume occupying at least 50% of the void.

2. The door latching mechanism of claim 1, wherein the insert is solid.

3. The door latching mechanism of claim 2, wherein the insert comprises zinc.

4. The door latching mechanism of claim 1, wherein the insert comprises zinc.

5. The door latching mechanism of claim 1, wherein the insert includes an aperture, the being spindle rotatably coupled to the frame and extending through the aperture.

6. The door latching mechanism of claim 5, further including a flange coupled to the frame and wherein the cover is coupled to the insert with at least a portion of the flange sandwiched between the cover and the insert.

7. The door latching mechanism of claim 1, wherein the slide is formed to include a cam surface and the spindle includes a cam, which engages the cam surface to translate rotational motion of the spindle around the chassis axis into linear motion of the slide perpendicular to the chassis axis.

8. A door latching mechanism, comprising:

a frame having two sidewalls in substantially parallel, spaced-apart relationship to each other, the sidewalls having outward faces;

a tubular spindle rotatably coupled to the frame and defining a chassis axis;

a slide slidably coupled to the frame and positioned between the two sidewalls of the frame;

a cover substantially enveloping the frame and having an open end, a closed end axially spaced from the open end, and an interior surface extending between the open end and the substantially closed end, the open end, the closed end, the interior surface of the cover, and the exterior surface of the frame defining a void; and an insert extending into the void and having an outer surface defining an insert volume, the insert volume occupying at least 50% of the void.

9. The door latching mechanism of claim 8, wherein the insert is coupled to the cover.

10. The door latching mechanism of claim 9, wherein the insert is screwed to the cover.

11. The door latching mechanism of claim 10, wherein the insert comprises zinc.

12. The door latching mechanism of claim 8, wherein the insert is formed to include two wings, each wing extending into the void on opposite sides of the slide from each other.

13. The door latching mechanism of claim 8, wherein the insert is formed to include an aperture and the spindle extends through the aperture.

14. A door latching mechanism, comprising:

a slide;

a spindle defining a chassis axis and being adapted to engage the slide and translate rotational motion of the spindle around the chassis axis into linear motion of the slide perpendicular to the chassis axis;

a frame having an exterior surface, the frame being formed to define a chamber adapted to facilitate sliding motion of the slide within the chamber and relative to the frame;

a cover housing the slide and having an open end, a closed end axially spaced from the open end, and an interior surface extending between the open end and the substantially closed end, the open end, the closed end, the interior surface of the cover, and the exterior surface of the frame defining a void; and an insert having two wings extending into the void, the two wings being positioned on opposite sides of the slide from each other, the insert having an outer surface defining an insert volume, the insert volume occupying at least 50% of the void.

15. The door latching mechanism of claim 14, wherein the wings are substantially parallel to each other and wherein the insert further includes a back wall which bridges between and is substantially perpendicular to the two wings.

16. The door latching mechanism of claim 15, wherein the back wall of the insert includes an aperture and the spindle extends through the aperture.

17. The door latching mechanism of claim 14, wherein the wings have exterior surfaces which are substantially parallel and adjacent to the interior surface of the cover.

18. The door latching mechanism of claim 17, wherein the insert is solid and comprises zinc.

19. The door latching mechanism of claim 14, wherein the insert is coupled to the cover.

20. The door latching mechanism of claim 19, wherein the cover is coupled to the wings of the insert using screws.

* * * * *

UNITED STATES PATENT AND TRADEMARK OFFICE

CERTIFICATE OF CORRECTION

PATENT NO. : 6,698,803 B2
DATED : March 2, 2004
INVENTOR(S) : Furlong

It is certified that error appears in the above-identified patent and that said Letters Patent is hereby corrected as shown below:

Title page,
Delete and substitute therefor new title page.

Drawings,
Sheets 1-3, delete and substitute therefor sheets 1-3,

Column 4,
Line 17, "being spindle" should be -- spindle being --.

Signed and Sealed this

Twenty-fourth Day of August, 2004

JON W. DUDAS
*Director of the United States Patent and Trademark Office*

(12) United States Patent
Furlong

(10) Patent No.: US 6,698,803 B2
(45) Date of Patent: Mar. 2, 2004

(54) DOOR LATCHING MECHANISM

(75) Inventor: Jonathan W. Furlong, Colorado Springs, CO (US)

(73) Assignee: Schlage Lock Company, Colorado Springs, CO (US)

( * ) Notice: Subject to any disclaimer, the term of this patent is extended or adjusted under 35 U.S.C. 154(b) by 0 days.

(21) Appl. No.: 09/760,410

(22) Filed: Jan. 12, 2001

(65) Prior Publication Data

US 2002/0093206 A1 Jul. 18, 2002

(51) Int. Cl.[7] ..... E05C 1/12

(52) U.S. Cl. ..... 292/165; 292/167; 292/169.15; 292/169.17; 292/169

(58) Field of Search ..... 292/165, 169, 292/169.17, 169.15, 167, 336.5

(56) References Cited

U.S. PATENT DOCUMENTS

| | | | |
|---|---|---|---|
| 2,538,688 | A | 1/1951 | Heyer |
| 2,733,088 | A | 1/1956 | Fisler et al. |
| 2,800,351 | A | 7/1957 | Schmid |
| 3,655,230 | A | 4/1972 | Armstrong |
| 4,169,618 | A | 10/1979 | Potter et al. |
| 4,424,691 | A | 1/1984 | Foshee |
| 4,428,212 | A | 1/1984 | Best et al. |
| 4,594,864 | A | 6/1986 | Hart |
| 4,662,198 | A | 5/1987 | Scherbing |
| 4,838,053 | A | 6/1989 | Shen |
| 4,869,083 | A | 9/1989 | DeMarseilles et al. |
| 4,930,822 | A | 6/1990 | Shen |
| 4,995,249 | A | 2/1991 | Preissler et al. |
| 5,020,343 | A | 6/1991 | Hart et al. |
| 5,123,682 | A | 6/1992 | Robida et al. |
| 5,141,269 | A | 8/1992 | Haq et al. |
| 5,177,987 | A | 1/1993 | Shen |
| 5,269,162 | A | 12/1993 | Robida et al. |
| 5,335,948 | A | 8/1994 | Norton, II et al. |
| 5,364,139 | A | 11/1994 | Bergen et al. |
| 5,385,374 | A | 1/1995 | Fann et al. |
| 5,564,296 | A | 10/1996 | Theriault et al. |
| 5,590,555 | A | 1/1997 | Kester et al. |
| 5,593,193 | A | 1/1997 | Heim |
| 5,605,064 | A | 2/1997 | Katayama et al. |
| 5,636,882 | A | 6/1997 | Hook |
| 5,727,406 | A | 3/1998 | Banducci |
| 5,732,578 | A | 3/1998 | Kang |
| 5,735,556 | A | 4/1998 | Chan |
| 5,761,936 | A | 6/1998 | Katayama |
| 5,768,926 | A | 6/1998 | Shen |
| 5,769,472 | A | 6/1998 | Small |
| 5,909,919 | A | 6/1999 | Wang |
| 5,983,687 | A | 11/1999 | Shen |
| 6,038,894 | A | 3/2000 | Hu |

*Primary Examiner*—Robert J. Sandy
*Assistant Examiner*—Matthew E. Rodgers
(74) *Attorney, Agent, or Firm*—Michael Best & Friedrich LLP

(57) ABSTRACT

A door latching mechanism includes a slide housed within a frame adapted for sliding motion of the slide within the frame and a spindle rotatably mounted to the frame and adapted to move the slide between a retracted and an extended position. A void is defined between an exterior surface of the frame and an interior surface of a cover housing the frame and the slide. An insert includes wings, which extend into the void and are positioned on opposite sides of the slide from each other.

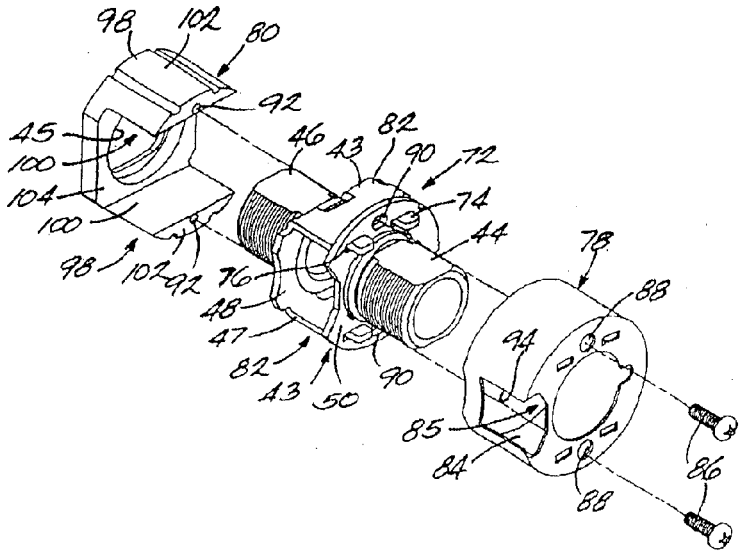

20 Claims, 3 Drawing Sheets